US005791631A

United States Patent [19]

Martin et al.

[11] Patent Number: 5,791,631

[45] Date of Patent: Aug. 11, 1998

[54] VALVING ASSEMBLY

[75] Inventors: David D. Martin, Dunbar; Douglas W. Ray, Irwin, both of Pa.

[73] Assignee: Robertshaw Controls Company, Richmond, Va.

[21] Appl. No.: 562,018

[22] Filed: Nov. 21, 1995

[51] Int. Cl.[6] ..... F16K 25/00

[52] U.S. Cl. ..... 251/210; 251/331; 251/77

[58] Field of Search ..... 251/210, 331, 251/77, 79, 80

[56] References Cited

U.S. PATENT DOCUMENTS

| | | | |
|---|---|---|---|
| 3,034,761 | 5/1962 | Janquart | 251/210 |
| 3,194,268 | 7/1965 | Vicenzi et al. | 251/210 X |
| 5,294,093 | 3/1994 | Huveteau et al. | 251/331 X |

*Primary Examiner*—Kevin Lee
*Attorney, Agent, or Firm*—Fulbright & Jaworski LLP

[57] ABSTRACT

A novel valving assembly that provides redundant control, eliminates separate gasketing, and assures proper valve seating, which includes a dual valve disk construction having a laterally extending integral web membrane.

19 Claims, 4 Drawing Sheets

VALVING ASSEMBLY

BACKGROUND OF THE INVENTION

The present invention relates to a novel valving assembly that provides redundant control in a single valve unit and eliminates the need for separate gasketing, and to devices utilizing same.

Many currently available devices, and particularly devices for the home, such as gas range and oven assemblies, hot water heaters, laundry equipment and the like, utilize natural gas or other combustible gases and fluids as a fuel source. These devices include valving assemblies for controlling the flow of the fluid. For example, gas range and oven assemblies utilize fuel gas, the flow of which is controlled by a series of valve assemblies.

Conventional valving assemblies typically include a movable elastomeric valve disk configured to seal against a mating metallic seat. The disk is moved by an energy-driven means, such as an electrical solenoid or motor, from engagement to disengagement with the seat to control the flow of fluid. The assemblies further include a gasket, located separate and apart from the valve disk and seat to retain the controlled fluid within the valve. Oftentimes, the gasket is positioned at the juncture of the valve body and the structure supporting the energy source.

Valve assemblies of this type generally also include a means of redundancy in controlling the fluid. This redundancy often is attained by placing two or more complete valve assemblies in series relationship in the fluid flow path. The multiple assemblies may form a common body or may exist separately. According to this arrangement, if one valve assembly fails to control the flow, the back-up assembly is available. Thus, devices that require valving for fluid control require costly duplicity of assemblies. The devices, and particularly the valve assemblies therein, also require additional parts, such as separate gasketing, which increase costs and assembly considerations.

A further limitation of typical valve assemblies is the limited ability to position the internal parts, and particularly the valve disk and the corresponding seat, to assure true and secure engagement and, thus, closing of the valve to fluid flow.

SUMMARY OF THE INVENTION

It is, therefore, an object of the present invention to provide a valve assembly that incorporates redundant control in a single valving mechanism.

Another object of the present invention is to provide a novel valve assembly that eliminates the need for separate gasketing.

A further object of the invention is to provide a valve assembly that allows improved relative vertical and lateral movement between the internal valving structure and the respective energy supply means to assure proper valve seating.

A still further object of the invention is to provide a valve assembly that includes a valve disk that may be readily assembled to the respective energy supply means without attendant assembly operations, e.g., welding or bending.

Thus, in accordance with the present invention, there is provided a valving assembly comprising dual valve disks and a web membrane extending outwardly of the valve disks. Preferably, the valve disks are positioned one above the other and the web membrane extends outwardly from the top disk. In another preferred embodiment, the valving assembly includes a valve moving means. The valve moving means preferably comprises an energy-providing means, a plunger and a valve carrier.

Hence, the present novel valve assembly achieves redundancy without the necessity of a multiplicity of valves. The novel assembly also eliminates the separate gasket required by prior art valves. Also, the novel assembly, by inclusion of its novel carrier design for attaching the energy source to the valve disk, enables necessary lateral and vertical relative movement of the energy source and the valve disk without the necessity of additional fastening processes, such as welding or bending.

Other and further objects, features and advantages will be apparent from the following description of presently preferred embodiments of the invention, given for the purpose of disclosure and taken in conjunction with the accompanying drawings.

DETAILED DESCRIPTION OF PREFERRED EMBODIMENTS

Figure 1:
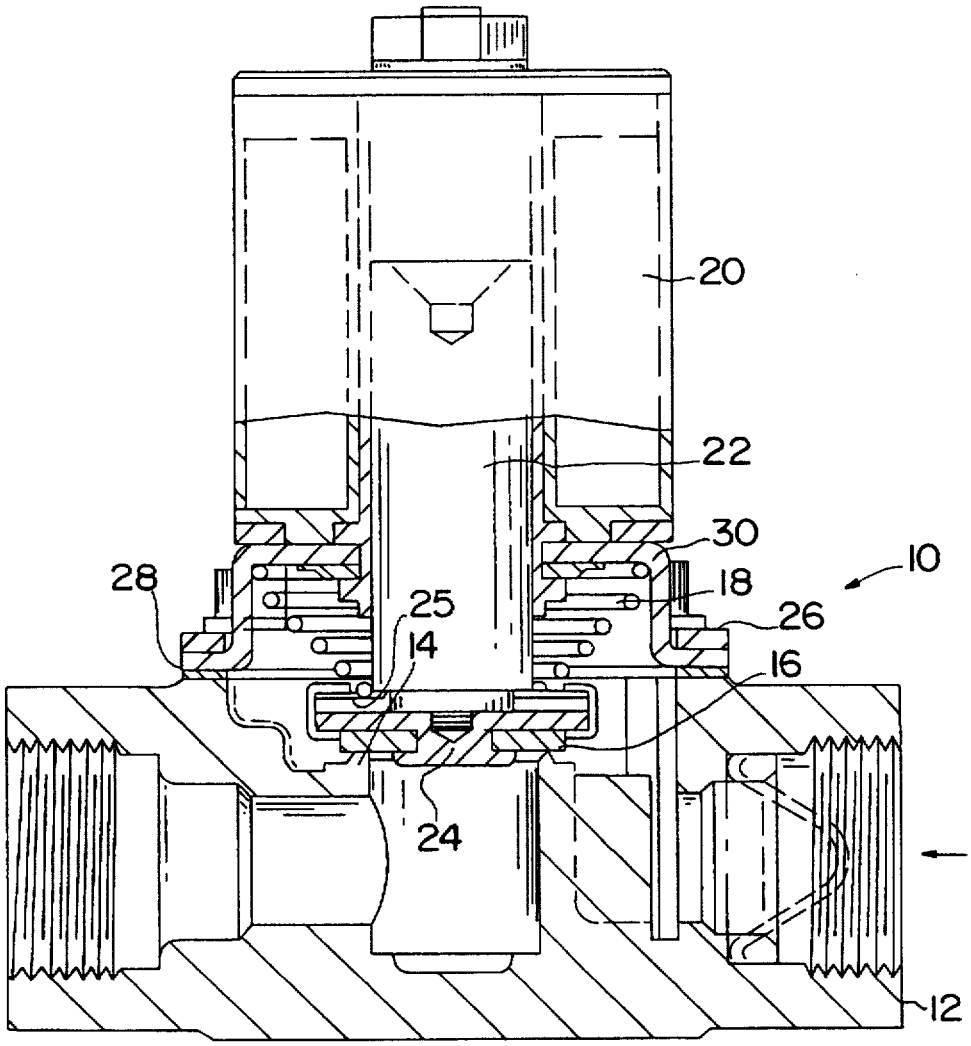
FIG. 1 is a partial cross-sectional view of a prior art valve assembly.

Currently available valve assemblies utilize an energy source to manipulate a valve disk into engagement and disengagement with a mating metallic seat to control the flow of fluid through the valve. For example, FIG. 1 illustrates a typical prior art valving assembly, generally referred to at 10. A metallic valve body 12 is shown. The valve body 12 includes an integral raised annular seat area 14. A mating elastomeric valve disk 16 is held in abutting relation to the seat area 14 by the force from spring 18. So configured, the assembly prevents the flow of fluid beyond seat area 14.

Energy source 20, an electrical solenoid in the illustrated embodiment, is attached to the body 12 and includes a plunger 22. The distal end of the plunger 22 is physically attached to the disk 16 by means of a carrier 24. The carrier is housed within a cage 26. Cage 26 is a two-piece assembly of metallic parts that must be assembled by welding or bending of tabs. Cage 26 is configured to allow the plunger 22 to move vertically before transmitting motion to the carrier 24, thus allowing momentum of the plunger to positively unseat valve disk 16 in the event the disk is sticking to seat area 14. Cage 26 is also configured to allow the carrier 24 to move slightly in a lateral direction so that it will hopefully seal against seat 14 in the event of misalignment of parts during manufacture of the assembly. Such vertical and horizontal movement is accomplished by the provision of a flange plate 25 positioned at the distal end of the plunger. The periphery of plate 25 engages the top of cage 26 when the plunger is in a partially retracted position. When the plunger is not retracted or retracted less than illustrated in FIG. 1, the plate has a limited vertical space within which to move without engaging the cage. Similarly, the plate 25, carrier 24 and disk 16 have a shorter diameter than the cage to assure relative lateral movement. Upon the supply of energy to the solenoid, the plunger will be drawn upwardly to break the seal between disk 16 and seat 14, thus allowing fluid flow past the seat 14.

The prior art valve assembly further includes a gasket 28 located at the juncture of the valve body 12 and the supporting means 30 of the energy source. This gasket is necessary to retain the controlled fluid within the valve.

Whenever a valve mechanism as described above is used to control the flow of a potentially dangerous fluid, such as a fuel gas, a means of redundancy in control is desirable. This redundancy may be attained by placing two or more complete valve assemblies in series in the fluid flow path, either within separate bodies or in a common body. Thus, if one valve mechanism fails to control the flow, another operable mechanism will be available.

In contrast, the present invention embodies a novel valve assembly that incorporates redundant control within a single mechanism by utilizing dual concentric valve disks and mating seats. Preferably, the assembly utilizes a membrane-type valve disk, which eliminates the need for a separate gasket. Furthermore, the assembly provides a novel construction which allows sufficient vertical and lateral relative movement between valve disks and energy source means to assure sufficient seating and unseating of the valve disk against the seat.

Figure 2A:
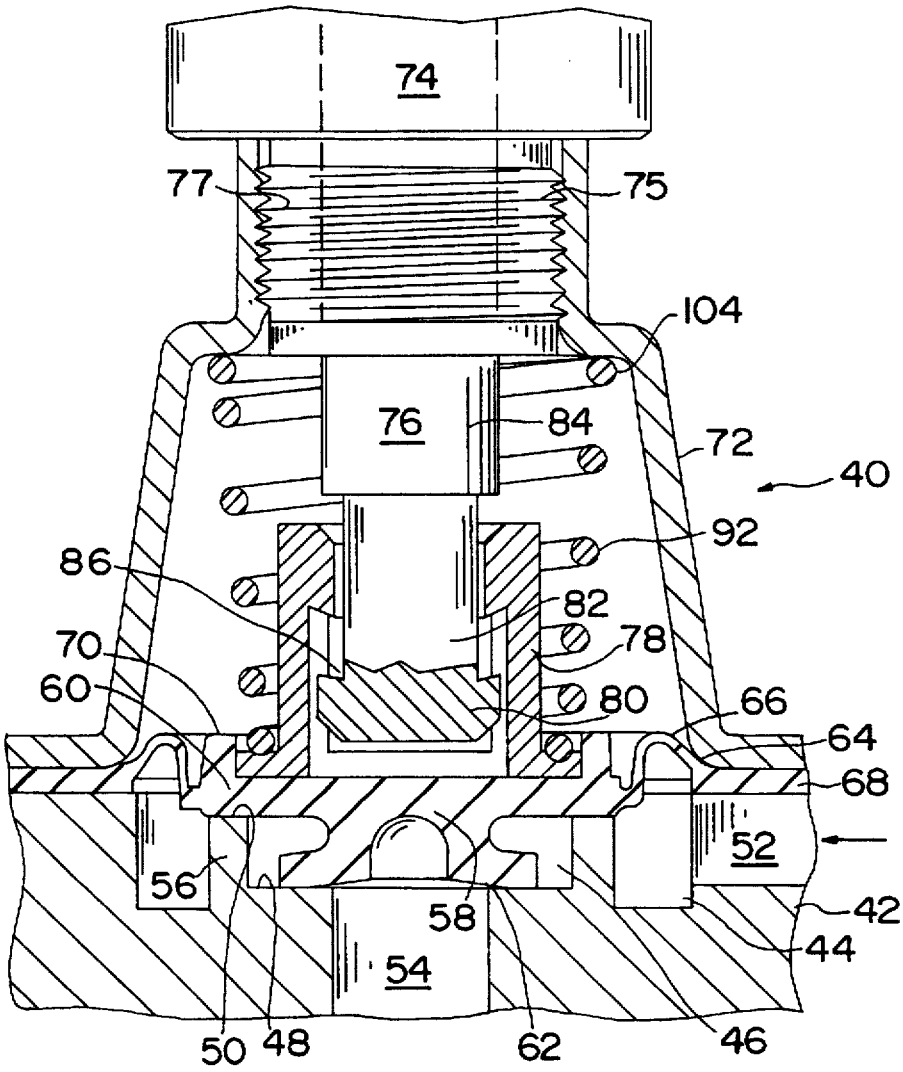
FIG. 2A is a cross-sectional view of the valve assembly in its closed position according to the present invention.

Referring now to FIG. 2A, the valve assembly 40 of the present invention is shown. The valve assembly 40 comprises a valve body 42 having outer chamber 44, inner chamber 46 and inner and outer seat surfaces 48 and 50. The body also includes inlet port 52 and outlet port 54. Inlet port 52 is in operative communication with outer chamber 44 such that fluid introduced to inlet 52 passes into and around chamber 44.

The seat surface 50 constitutes the terminal end surfaces of upstanding wall 56. Wall 56 forms the inner wall surface of the outer chamber 44 and the outer wall surface of inner chamber 46.

The assembly further includes an integral dual valve disk unit 58 having a first outer disk 60, a second inner disk 62 and membrane portion 64. Outer disk 60 is designed for abutting engagement with outer seat surface 50 under select operational conditions, i.e., when the valve is in the closed position. Likewise, inner disk 62 is designed for similar engagement with the seat surface 48 in the valve-closed condition.

The outer and inner chambers may be manufactured in a variety of geometries. In a preferred embodiment, the outer chamber is annularly-shaped and the inner chamber assumes a matching circular shape. Likewise, preferably, the outer and inner disks 60 and 62 are circular to facilitate manufacture; however, they may be of any desired shape as long as they provide sufficient contact and engagement with the seat surfaces to assure a tight seal against fluid flow in the closed position.

The membrane 64 is integral to the inner and outer disks. As illustrated, it extends outwardly from the outer disk in the form of an upstanding shoulder 66 and lateral web 68. The membrane also includes upstanding positioner 70. The membrane may assume a variety of profiles, for example, the shoulder 66 may be excluded, thus having the web extending outwardly from the positioner 70. Alternatively, the shoulder could serve as a positioner and the positioner 70 could be eliminated. Irrespective of the particular profile, the important feature of the membrane is that it is integral to the valve disks and is positioned outboard of the outer disk between valve cover 72 and body 42 to assure a seal against fluid leakage.

Figure 3:
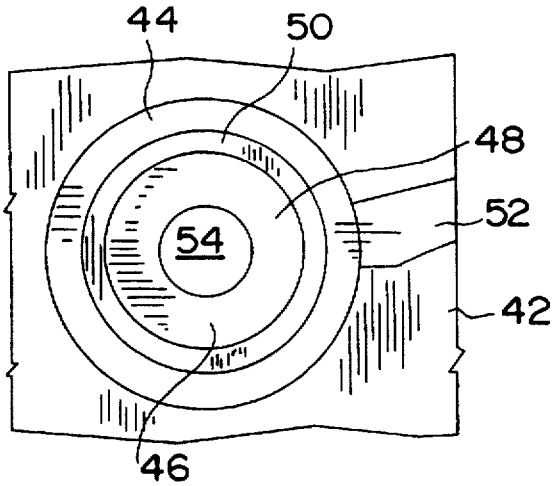
FIG. 3 is a top plan view of a valve body taken along lines 3—3 of FIG. 2B.
Figure 4:
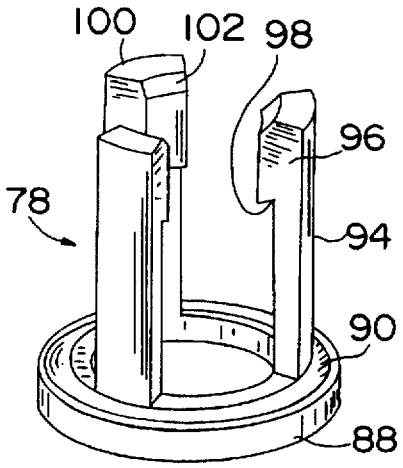
FIG. 4 is a perspective view of one embodiment of a valve carrier according to the present invention.

FIG. 3 is a top plan view of the body 42 and illustrates the relationship between the chambers, walls and ports of the instant valve assembly. Specifically, inlet port 52 is shown in operative communication with outer chamber 44. Immediately inboard of chamber 44 is outer seat surface 50 of upstanding wall 56, which separates outer chamber 44 from inner chamber 46. Inner seat surface 48 is illustrated as comprising the base of inner chamber 46. Finally, outlet port 54 is shown as leading from inner chamber 46.

Referring again to FIG. 2A, as mentioned above, the valve assembly also includes a cover 72. Connected to and partially housed within cover 72 is valve operating means 74. Valve operating means 74 can be selected from a variety of such structures, including an electrical solenoid, a pneumatic cylinder, an electric motor, a manually operated device, or any other suitable energy source that will cause the valve disks to respectively engage and disengage from their respective seating surfaces. A preferred such structure is an electrical solenoid of the type illustrated in FIG. 2A. As illustrated, the solenoid 74 comprises a threaded distal end 75 that corresponds to and mates with an internal thread pattern 77 of the cover 72.

In the case of an electrical solenoid, the assembly further includes a plunger 76. The plunger physically engages a valve carrier 78, which, in turn, is retained by membrane 64. The plunger 76 has a distal portion 80 having an outer diameter larger than the outer diameter of the portion of the plunger immediately proximal thereto 82. Depending upon design conditions, the end 84 of the plunger opposite end 80 may have an outer diameter larger than portion 82, as illustrated in FIG. 2A. The difference in diameters between distal end 80 and plunger portion 82 creates a shoulder 86 of the plunger which engages the valve carrier 78.

Figure 5:
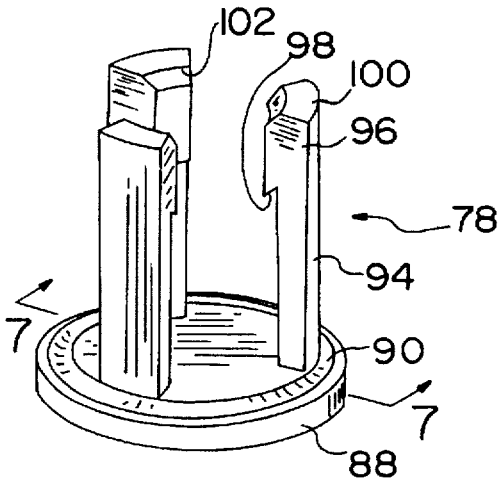
FIG. 5 is a perspective view of another embodiment of a valve carrier according to the present invention.
Figure 6:
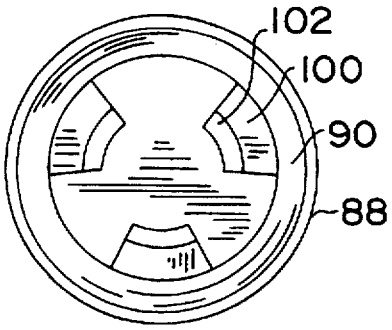
FIG. 6 is a top plan view of the valve carrier of FIG. 5.
Figure 7:
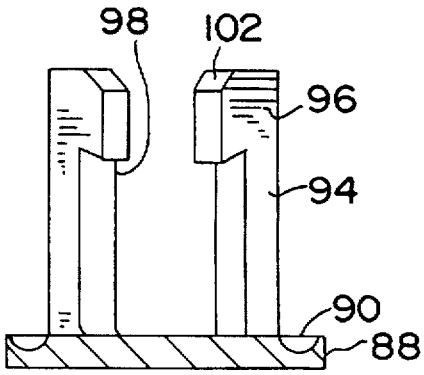
FIG. 7 is a cross-sectional view of the valve carrier taken along lines 7—7 of FIG. 5.

The valve carrier of the present invention is more specifically shown in FIGS. 4–7. The carrier comprises a base 88. The base may be in the form of a ring (FIG. 4) or a solid disk (FIG. 5). Also, though the base is illustrated as being circular in the various figures, it will be readily apparent that the base may assume a variety of shapes as long as the shape assures proper alignment with the membrane 64. A depression 90 may be included in the base 88 to receive one end of the spring 92.

The valve carrier 78 also includes a multiplicity of appendages 94 extending from the base 88 longitudinally relative to the movement of the plunger. Each appendage terminates in an inwardly extending portion 96. The portion 96 is dimensioned to mate with shoulder 86 of the plunger. The surface 98 of portion 96 may assume a variety of angles relative to the angle of shoulder 86 of the plunger. In a preferred embodiment, the surface extends inwardly downwardly and mates with a mirror image surface of the shoulder.

Further, the end surface 100 of the portion 96 may have a bevelled inner portion 102. This bevelled portion, upon insertion of the plunger 76 into the carrier, causes the appendages 94 to spread radially apart to allow the plunger to be received by the carrier.

Referring again to FIG. 2A, the valve carrier 78 may be attached to the membrane in a variety of fashions as long as the attachment is sufficiently secure to withstand the lifting force applied by the energy source and, thus, to remain engaged to the membrane. In a preferred embodiment, the carrier is bonded by suitable adhesive means. In an alternative embodiment, the carrier is mechanically attached to the membrane.

The valve assembly also includes spring 92. The spring encompasses appendages 94 and plunger 76. One end of the spring abuts the valve carrier or membrane. As previously noted, according to a preferred embodiment, the end of the spring is retained by depression 90 in the valve carrier base. The other end of the spring abuts the cover 72. According to a preferred embodiment as illustrated in FIG. 2A, the cover flares laterally outwardly and then tapers outwardly and downwardly toward the valve body to create a shoulder 104 against which the spring end rests.

Though not illustrated, a backup-plate may be placed adjacent to the side of the lateral web 68 opposite the valve body. The plate may have an opening having a diameter essentially equal to the distance between the outboard edges of corresponding shoulders 66. So constructed, the back-up plate provides additional rigidity to the web 68 and more easily controlled means of defining effective valving diameter.

Figure 2B:
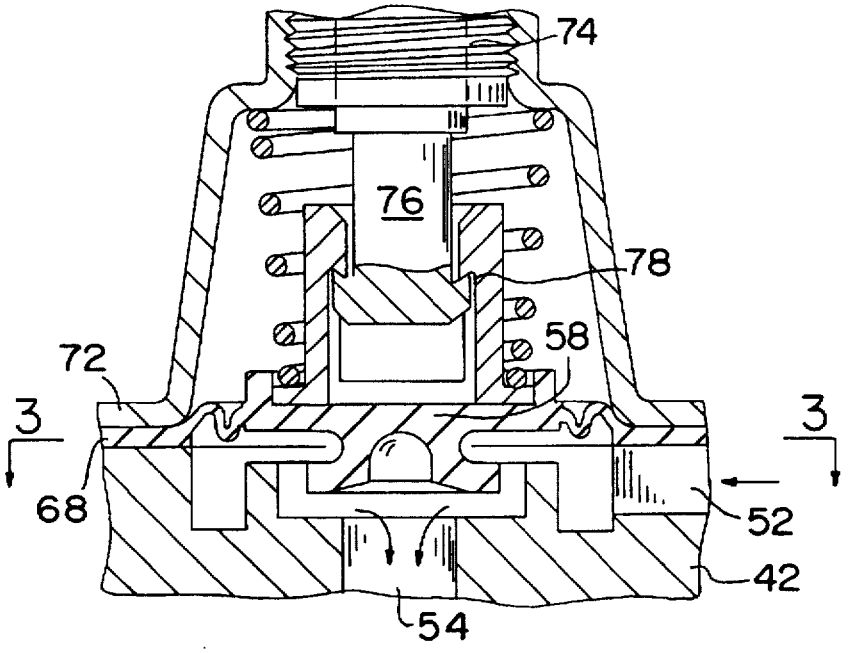
FIG. 2B is a cross-sectional view of the valve assembly in its open position according to the present invention.

FIG. 2B illustrates the same valve assembly as that depicted in FIG. 2A, except in the valve-open position. Accordingly, identical structure will be given identical reference numbers. In the open position, the valve disk 58 is lifted relative to valve body 42. In this position, the plunger 76 is retracted in the solenoid 74 and the shoulder 86 of the plunger engages the valve carrier. The disengagement of the valve disk from the valve body opens communication of inlet port 52 to outlet port 54. Finally, however, the web membrane 68 remains secured between valve cover 72 and valve body 42 to assure that the valve is secured against leakage.

The valve body 42 may be manufactured utilizing a variety of materials and techniques. For example, the body may be any suitable material that will withstand the conditions of the operating environment. For example, in the case of a gas range, the body should be made from a material that can withstand significantly high temperatures. A preferred material is die cast aluminum.

The flexible membrane 64 may be made from a variety of materials that offer sufficient flexibility. For example, a variety of elastomeric materials are suitable for use. Particularly preferred is silicone rubber.

The cover may be constructed from a variety of materials that can be formed into the necessary shape and can withstand the applications to which the valve assembly will be exposed. A preferred material of construction is stamped plated steel. Also applicable are cast aluminum and stainless steel.

The valve carrier may be constructed from a variety of materials that have sufficient flexibility to deform to receive the plunger, yet will return to their original shape while retaining the plunger within. A preferred material is a moldable plastic material, such as an acetal or polyamide.

The spring may be constructed in any manner so as to hold the valve disks against the valve seats. A preferred construction is coiled spring tempered wire.

Assembly of the instant valve assembly is straightforward. While it will be obvious to one skilled in the art that the assembly steps may be performed in a variety of orders, the following description will describe one such assembly order. First, the valve body is machined, cast or constructed in any other known manner to provide the chambers, surfaces and ports described above.

The flexible membrane is likewise produced using known methods to provide the required integral profile. As previously noted, the membrane may assume a variety of profiles each presenting at least dual valve disks and a web membrane integral to and extending laterally outwardly from the dual disks. For example, the membrane may include a positioner, as described above, for positioning the valve carrier. Similarly, the membrane may include a detent or depression in the area of the valve carrier to receive the spring.

Furthermore, the membrane is constructed with the shoulders 66 to assure that the valve may be fully opened without force being applied in the web region 68 to assure that the web remains securely positioned.

Also, the valve disks themselves may have a variety of designs. As noted, the disks are preferably circular due to manufacturing concerns; however, non-circular profiles are possible as long as the disks properly seat and close the outlet port against fluid flow. Also, the relative spacing of the disks is important and may assume a variety of designs. Preferably, outer disk 60 is positioned relative to inner disk 62 such that the inner disk seats against seating surface 48 prior to engagement of the outer disk with seating surface 50. As such, the assembly is assured that, in the closed position, both seals are made and redundancy achieved, absent external interference such as the positioning of a particulate on one of the seating surfaces.

So constructed, the membrane next receives the valve carrier. The carrier can be secured to the membrane by a variety of methods, including adhesion and constructural mating of the membrane and carrier. Whichever method is used, it must provide a connection sufficient to withstand the lifting force applied to the assembly.

Next, the membrane, with valve carrier, can be positioned relative to the valve body. The spring 92 can be slid over the carrier and the plunger inserted into the carrier. The valve cover then can be secured to the body and the energy source, e.g., electrical solenoid, attached to the body and aligned with the plunger. Due to the novel membrane and cover construction, great latitude is provided to correctly position the disks in relation to the seat surfaces. As a result of the above-described novel construction, additional separate gasketing is not required.

So constructed, the valve assembly presents the novel dual disk and integral membrane structure of the present invention.

In operation, and assuming the electrical source is not actuated, the valve is closed. The inner and outer disks, 62 and 60, respectively, are securely engaged against seating surfaces 48 and 50, respectively, and inlet port 52 is not in communication with outlet port 54. Upon change in operating conditions, a signal is received to open the valve. Accordingly, an energy source, be it electrical, mechanical or manual, is sent to the valve assembly. According to the illustrated embodiment, an electrical current is sent to the solenoid 74. The solenoid, upon receiving the current, creates a magnetic field in its electrical winding, thus drawing the plunger 76 upwardly into the solenoid. The plunger gathers momentum in its upward movement. After travel of a vertical distance determined by the distance between the distal end 80 of the plunger and the portion 96 of the valve carrier in the closed position, the plunger engages the valve carrier and the plunger's momentum is transferred to the carrier, as necessary, to disengage the disks from the valve seats. Upon disengagement, the plunger continues its retraction until a sufficiently wide fluid passageway is presented between outer chamber 44 and inner chamber 46. The valve remains open until a close signal is received and the valve assembly returns to its original position.

Due to the configuration of surface 98 of the valve carrier 78 and mating shoulder 86 of the plunger 76, a radially inward force is exerted on valve carrier appendages 94 when plunger 76 is retracted. This force helps to keep plunger 76 and valve carrier 78 properly mated and prevents them from separating.

The instant valve assembly has many applications. For example, it may be used in gas oven/range assemblies to control gas flow to the burner assemblies. It may also be used in laundry equipment to provide gas flow to necessary burners. In another application, the valve assembly may be used in fluid dispensing devices, such as vending machines.

Thus, the novel valve assembly provides redundant valving in one assembly through its incorporation of dual valving disks. It also incorporates integral sealing ability through its laterally extending web membrane. In addition, the assembly allows vertical and lateral movement between the valve disks and energy supply means as a result of the novel valve carrier construction.

The present invention, therefore, is well-adapted to carry out the objects and attain the ends and advantages mentioned, as well as others inherent therein. While presently preferred embodiments of the invention have been given for the purpose of disclosure, numerous changes in the details of construction, arrangement of parts, and steps of the process, may be made which will readily suggest themselves to those skilled in the art and which are encompassed within the spirit of the invention and the scope of the appended claims.

What is claimed is:

1. A valving assembly, comprising:

a valve body;

an integral dual valve disk unit having a first valve disk, a second valve disk, said first and second disks having sealing surfaces facing the same direction, and a web membrane extending outwardly of said valve disks and secured to said valve body; and first and second valve seats facing in the same direction and facing opposite to said sealing surfaces of said first and second valve disks, and positioned to engage said sealing surfaces of the first and second disks, respectively, on movement of said valve disk unit toward said seats.

2. The valving assembly of claim 1 wherein the web membrane is connected to and extends from the first valve disk.

3. The valving assembly of claim 1 wherein all of the sealing surfaces and valve seats are flat.

4. A valving assembly, comprising:

an integral dual valve disk unit having a first valve disk, a second valve disk, said first and second disks having sealing surfaces facing the same direction, and a web membrane extending outwardly of said valve disks;

first and second valve seats facing in the same direction and facing opposite to said sealing surfaces of said first and second valve disks, and positioned to engage the sealing surfaces of said first and second disks, respectively, on movement of said valve disk unit toward said seats; and an energy providing means, a plunger, and a valve carrier for moving said integral dual unit, wherein said valve carrier is telescopically slidable relative to said plunger.

5. The valving assembly of claim 4 wherein the valve carrier includes a base, a plurality of flexible appendages extending from the base and inwardly extending portions at the end of the appendages opposite the base.

6. The valving assembly of claim 5 wherein the inwardly extending portions extend at an angle toward the base, and said plunger includes shoulders coacting with the inwardly extending portions.

7. A valving assembly, comprising:

valve body;

an integral dual valve disk unit having a first valve disk, a second valve disk, said first and second disks having coaxial sealing surfaces facing the same direction and moving in a path of travel, and a web membrane extending outwardly of said valve disks and secured to said valve body;

first and second coaxial valve seats each facing the same direction and each positioned in the path of travel to engage the sealing surfaces of said first and second disks, respectively, on movement of said valve disk unit toward said seats;

spring means for biasing said valve disk unit toward said seats; and means for moving the valve disk unit away from said seats, including an energy source, a plunger, and a valve carrier.

8. The valving assembly of claim 7 wherein said valve carrier includes a base, a plurality of flexible appendages extending from the base and inwardly extending portions at the end of said appendages opposite the base.

9. The valving assembly of claim 8 wherein said inwardly extending portions extend at an angle toward the base, and said plunger includes shoulders coacting with the inwardly extending portions.

10. The valving assembly of claim 7 wherein the web membrane is connected to and extends from the first valve disk.

11. The valving assembly of claim 7 including wherein all of the sealing surfaces and valve seats are flat.

12. A valving assembly, comprising:

an integral dual valve disk unit having a first valve disk, a second valve disk, said first and second disks having coaxial sealing surfaces facing the same direction and moving in a path of travel, and a web membrane extending outwardly of said valve disks;

first and second coaxial valve seats each facing the same direction and each positioned in the path of travel to engage said sealing surfaces of said first and second disks, respectively, on movement of said valve disk unit toward said seats;

spring means for biasing said valve disk unit toward said seats;

means for moving said valve disk unit away from said seats, including an energy source, a plunger, and a valve carrier, wherein said valve carrier is telescopically slidable relative to said plunger.

13. A valving assembly, comprising:

a valve disk unit having dual valve disks;

valve seats confronting said valve disks and respectively receiving same in a first position;

spring means for biasing said valve disks seated against said valve seats in said first position;

means for moving said disks, including:

an energy source, a plunger, and a valve carrier for unseating said valve disks in a second position; and an actuator adapted for retracting said valve disks in said second position by force applied to said valve carrier, wherein said valve carrier includes:

a base, a plurality of flexible appendages extending from said base, and inwardly extending portions at the end of said appendages opposite said base.

14. The valving assembly of claim 13, wherein the inwardly extending portions extend at an angle toward the base, and the plunger includes shoulders coacting with the inwardly extending portions.

15. A valving assembly, comprising:

a valve body;

a valve disk unit having dual valve disks;

a web membrane extending outwardly of said valve disks and secured to said valve body; and means for moving the valve disks, comprising:

an energy-providing means, a plunger, and a valve carrier.

16. A valving assembly, comprising:

valve disk unit having dual valve disks;

a web membrane extending outwardly of said valve disks; and means for moving said valve disks, comprising:

an energy-providing means, a plunger, and a valve carrier, wherein said valve carrier includes:

a base, a plurality of flexible appendages extending from said base, and inwardly extending portions at the end of said appendages opposite said base.

17. The valving assembly of claim 16, wherein the inwardly extending portions extend at an angle toward the base, and the plunger includes shoulders coacting with the inwardly extending portions.

18. A valving assembly, comprising:

a valve disk unit having dual valve disks;

a valve moving means; and means for positioning the valve moving means;

a valve carrier which comprises:

a base, appendages extending from the base, and inwardly extending portions at the end of said appendages opposite the base.

19. The valving assembly of claim 18, wherein the inwardly extending portions extend at an angle toward the base, and further including a plunger having shoulders coacting with the inwardly extending portions.

* * * * *